United States Patent [19]

Whellams

[11] 4,334,653

[45] Jun. 15, 1982

[54] FILAMENT TENSIONING APPARATUS

[76] Inventor: Geoffrey E. Whellams, 3 Spruce Ave., Greenstead, Colchester, Essex, England

[21] Appl. No.: 133,840

[22] Filed: Mar. 25, 1980

[51] Int. Cl.[3] ..... B65H 49/00

[52] U.S. Cl. ..... 242/129.8; 242/128

[58] Field of Search ..... 242/128, 129.8, 137.1, 242/138, 153, 154

[56] References Cited

U.S. PATENT DOCUMENTS

| | | | |
|---|---|---|---|
| 3,203,642 | 8/1965 | Hirst | 242/128 |
| 3,284,024 | 11/1966 | Franzen | 242/128 |
| 4,106,712 | 8/1978 | Savio et al. | 242/47.01 |

*Primary Examiner*—Leonard D. Christian

*Attorney, Agent, or Firm*—Varnum, Riddering, Wierengo & Christenson

[57] ABSTRACT

Wire tensioning apparatus comprises a holder for a reel of wire and first and second tensioning elements arranged to be supported adjacent one end of a held reel. Each tensioning element has at least one annular surface, the annular surfaces on the two elements cooperating to define a non-linear circular passage along which a wire may pass generally radially inwardly, the wire entering the passage at any point in the 360° arcuate extent of the passage. One element has a central aperture, so that wire may spill off a held reel, enter the non-linear passage and leave through the central aperture, tension being imparted by the wire following a zig-zag path as the wire passes through the passage.

13 Claims, 7 Drawing Figures

FILAMENT TENSIONING APPARATUS

BACKGROUND OF THE INVENTION (a) Field of the Invention

This invention relates to a tensioning device for imparting a tension to a filament drawn from a reel, as the filament is passed to apparatus which employs the filament. Though not exclusively, the invention finds particular application in the tensioning of relatively fine wire drawn from a reel thereof as the wire is passed to coil-winding apparatus—for instance which winds a transformer winding.

(b) Description of the Prior Art

Various types of tensioning device have been designed, taking into account the material of the particular filament being used and the processing apparatus in which the filament subsequently is employed. This tension is in fact the tensile force which must be applied to the filament in order to draw it to the process. An example of a known tensioning device for fine copper wire comprises a plurality of hard circular beads arranged in two series and through which the wire is passed, the beads of the two series being disposed alternately and the axes of the two series being parallel but displaced from one another. A wire passing through the device thus follows a zig-zag path and the internal and external friction so generated as the wire moves creates the tension. Often with fine enamelled copper wire it is found necessary to apply a pre-tension to the wire, by passing the wire between a pair of friction elements such as felt pads, to ensure that the wire is loaded effectively to follow the zig-zag path.

Such a tensioning device is typically located between but separate from both a reel holder for the wire and the machinery which uses the wire in a subsequent process. The tensioning device is however sometimes integrated with the processing machinery. The relative displacement of the axes of the two series of beads has to be adjusted to give the required tension, but the tension is dependent also upon the characteristics of the wire—such as the gauge and the insulation thereon. Thus, adjustment is necessary whenever a reel of wire is changed for another of a different type, even if the same tension is required. Moreover, the friction between the wires and the beads tends rapidly to wear the beads by forming grooves therein, even if the beads are made of hard materials such as ceramics or glass. This leads to the requirement to adjust the device merely to maintain a required tension, during the use of the device with a particular type of wire. In addition, because insulation coatings have minor thickness variations on any given length of wire the grooves worn in the beads give rise to rapidly changing tensions as the wire is pulled through the device. Moreover, the grooves tend to strip the insulation from the wire.

OBJECTS OF THE INVENTION

It is a primary object of this invention to provide means for holding a reel of filament which means tensions the filament as the filament is drawn from the reel. A further object is to provide such means which reliably can tension the filament to a uniform extent for the entire length of a filament wound on a reel held by the holding means.

Yet another object is to provide means for both holding a reel of filament and tensioning the filament as the filament is drawn from the reel, which means is adapted to hold a reel of a particular, standard size, and automatically to apply an appropriate tension to the filament drawn from the reel.

A further object is to provide a reel holder and tensioning means for a filament drawn from a held reel, which is relatively cheap to manufacture by a plastics moulding process, so that the reel holder and tensioning means can be thrown away after a held reel of filament is exhausted, thereby minimising the effects of wear on the tensioning means and variations in tension consequent thereon.

Moreover, it is a general aim of this invention to provide apparatus suitable for holding a reel of filament and especially fine electrical wire which apparatus also imparts a tension to the wire as the wire is drawn from the reel, the apparatus at least reducing the disadvantages associated with the known type of bead tensioning device as has been described above.

SUMMARY OF THE INVENTION

According to this invention, there is provided a device for imparting a tension to a filament drawn from a reel, which device comprises holding means for holding a reel of filament, first and second circular tensioning elements, and support means for supporting said elements in a relatively spaced disposition to lie adjacent one end of a reel held by said holding means, each of said tensioning elements having at least one annular surface, which said annular surfaces on said two elements co-operate with each other thereby to define a non-linear passage of circular form between said elements and along which a filament may pass generally radially inwardly, said support means supporting both of said elements with said annular surfaces substantially co-axial with and adjacent one end of a reel held by the holding means and at least one of said elements having a central aperture through which filament drawn from the reel and passing radially inwardly through said passage may leave the device, whereby the filament wound on a held reel may be drawn from the reel to pass generally radially inwardly along said passage there to be constrained to follow a non-linear path and out of said aperture, said non-linear path imparting tension to the filament and the filament being able to enter the passage at any point around the circular periphery thereof as the filament comes off the reel.

It will be appreciated that the tensioning device of this invention is integrated with a reel holder, and thus is more convenient to use than an arrangement in which a tensioning device is provided as a separate entity to a spool or reel holder. Moreover, because a filament may be accepted into the passage anywhere over the 360° extent thereof as the filament comes off a held reel, wear is spread uniformly over the co-operating annular surfaces defining the non-linear passage, and there is virtually no tendency for grooves to wear in either tensioning element at localised points, as compared to known bead tensioners, when wear is concentrated at localised points.

BRIEF DESCRIPTION OF THE DRAWINGS

The accompanying drawings will serve to illustrate various specific and preferred embodiments of this invention. In the drawings.

DESCRIPTION OF THE PREFERRED EMBODIMENTS

Figure 1:
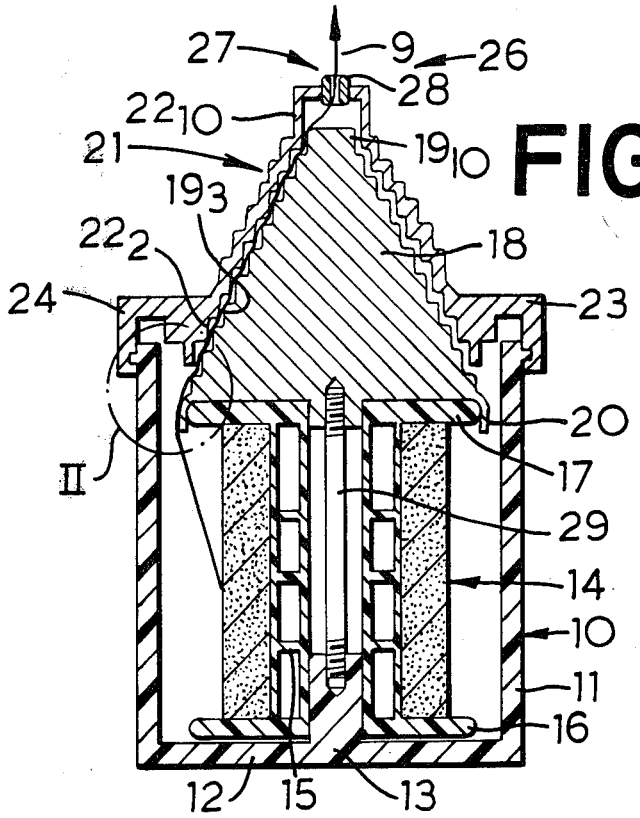
FIG. 1 is a cross-sectional view through a first embodiment of reel holder and wire tensioning device.

The device of this invention both for holding a reel and imparting tension to a filament drawn from the reel may be constructed in any one of a number of ways. In particular, the circular tensioning elements may take any of a variety of forms and configurations, provided that the two elements together define the non-linear filament passage and may be supported adjacent one end of a held reel. In the most preferred example, the two elements are in the form of a pair of complementary stepped cylinders which interfit with clearance, the filament passage extending therebetween. Thus, one element has at least two external concentric cylindrical portions of different diameters, the larger portion being adapted for positioning nearer a held reel, the other element having at least two corresponding internal cylindrical portions, this other element fitting over said one element. Another possibility would be for the elements each to be defined by a plurality of rings of different diameters and spatially fixed with respect to one another, the rings of one element alternating with those of the other. In effect, such an arrangement may be considered equivalent to the above described example of stepped cylinders, the rings being disposed at the steps where the diameters change in the stepped cylinders, for a filament passing through the former example of elements only touches the elements alternately at the steps, thereby following a zig-zag path between the elements: such a path can suitably be defined by the rings. Yet another possibility is for one element to be in the form of a stepped cylinder, the other element having a plurality of flanges projecting radially inwardly from an internal cylindrical surface, the flanges defining circular apertures of sizes suitable for co-operation with the steps in the cylinder. Various other equivalent structures could be designed, to constrain a filament to follow a zig-zag path between the elements. A further possibility is for the stepped cylinders mentioned above to be inverted; that is to say, the element nearer the reel is shaped to fit over and around the other element, the smallest diameter portion of the other element being nearest the reel.

In another preferred embodiment, each element is in the form of a substantially flat disc, the two discs being disposed co-axially, parallel to one another and on their opposed faces having annular upstanding protrusions, those on one disc interfitting between those on the other. In this way, a labyrinth-like structure is obtained, with the non-linear circular filament passage extending between the discs, from any point on the periphery thereof towards the central aperture.

In any of the above described preferred embodiments, the passage for the filament has an effective width of 360° of arc so that a filament may enter the passage at any point therearound as the filament is drawn generally radially inwardly towards the aperture, the filament being constrained to follow a non-linear path through the passage. It will be appreciated that the path of a filament will not be strictly radially inwardly but will have a circular component as well, because as the filament spills over the end of the reel, the filament will run round the reel and the point at which the filament enters the passage constantly will be changing.

It is much preferred for the parts of the elements against which the filament rubs, especially at the circular entrance to the passage, to be rounded to prevent too high point loads occurring on the filament, to reduce the likelihood of breakages or damage to insulation coatings which may be present on the filament.

In the device of this invention, the support means serves to support the two elements with a particular spacing therebetween to define the filament passage. Though the device could be made non-adjustable, with the support means pre-set during manufacture to give an appropriate element spacing, it is preferred for the support means to be adjustable over a small range to allow the element spacing to be varied thereby to give a required tension to a particular filament. However, because element wear is spread over the entire 360° of each element, it is found that rates of wear are very low and adjustment is necessary only on initial setting-up but not subsequently during use with a particular filament. Calibration may be provided on the adjustable parts to allow simple re-setting to a given position following for example a reel-change.

A reel of filament is preferably held in the device by being sandwiched between an end plate of the device and one of the two elements of the pair thereof. The one element preferably also has an overall diameter substantially the same as the end of the reel, so that the filament may smoothly be drawn from the reel, over the end cheek thereof and into the passage between the two elements. Threading the filament through the passage merely requires the filament to be laid over the one element when moved to its position in which the end cheek of the reel is abutted thereby, threading the filament through the central aperture, and then bringing the other element to its required adjusted position. If a different tension is required, then either a different adjustment could be set, or a different pair of elements could be used, if the required tension is out-of-range of the pair previously used.

The central aperture could be disposed so that the filament, on leaving the passage, moves generally axially away from the reel. An alternative is for the aperture to be in the element nearer the reel, the filament on leaving the passage turning to pass through the central bore of the reel and out of the end thereof remote from the elements, to leave the device. Either way, the holding means advantageously is arranged to clamp the reel between an end plate of the device and one of the elements, the means for instance comprising a tie rod extending through the core of the reel and threaded into the end plate and the one element. In the case in which the filament leaves the device through the centre of the reel, the tie rod would have to be hollow to define a passageway for the filament.

For certain types of filaments and/or required tensions, it may be advantageous to apply a pre-tension to the filament, prior to the filament passing through the passage defined between the two elements. Such pretension may be applied by means of a resilient member bearing on one of the elements adjacent the periphery thereof, the filament passing between the resilient member and the one element before entering the passage between the two elements.

Reference will now be made to the accompanying drawings, which illustrate in greater detail the preferred embodiments of this invention described above.

Figure 2:
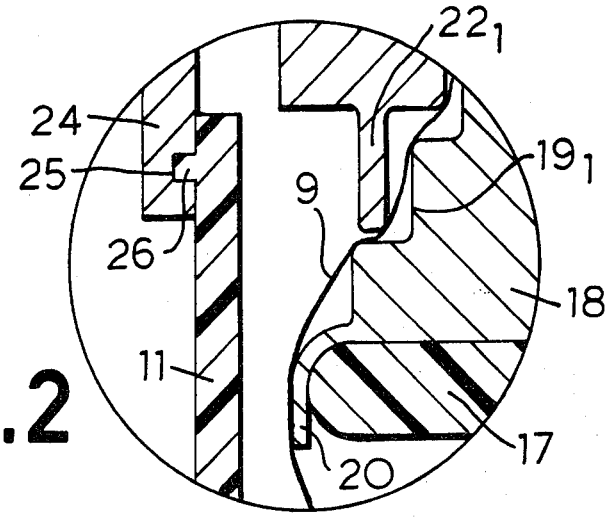
FIG. 2 is a detailed view of part of the device encircled in FIG. 1 and marked II.

Referring initially to FIGS. 1 and 2, there is shown a first embodiment of tensioning device arranged for adjustably tensioning a fine wire drawn from a reel held in the device. The device comprises a reel holder 10 having a cylindrical wall 11 and an end wall 12, there being an internally-threaded peg 13 upstanding centrally from the end wall 12 and on which a reel 14 is located. The peg 13 should suitably be shaped so that the bore through the centre of the reel is a light press-fit thereon.

The reel itself with which the device is intended to be used is of a standard shape and size, being moulded from a plastics material and having a core 15 supporting a pair of end cheeks 16, 17. When the reel is located in the holder 10 on peg 13, one end cheek 16 abuts the end wall 12, and the cylindrical wall 11 fits with clearance around the cheeks 16, 17. The other end cheek 17 supports one element 18 of a complementary pair thereof, which are adapted to impart tension—that is, drag or resistance to movement—as the wire is pulled from the device, as described below.

The one element 18 is in the form of a plurality of cylindrical portions $19_1$, $19_2$, $19_3$ . . . of decreasing diameter but each of substantially the same axial extent. Depending from the largest diameter cylindrical portion $19_1$ is a lip 20 defining a recess into which the end cheek 17 is lightly press-fitted. The other element 21 is formed internally with a corresponding plurality of cylindrical portions $22_1$, $22_2$, . . . so that the element 21 may be positioned over the element 18 but with clearance therebetween. The larger diameter end 23 of the element 21 is provided with a skirt 24 defining a bore which fits slidingly over the outer surface of the holder wall 11. Formed internally in the skirt is a helical groove 25, in which is located a lug 26 projecting from the wall 11 of the holder 10. Rotation of the element 21 relative to the holder thus causes the element 21 to move axially of the holder, and hence varies the clearance between the two elements 18 and 21.

At the smaller diameter end 26 of the element 21 is a central aperture 27, bound by bead 28 of a relatively hard material, such as glass or a ceramic. The elements 18 and 21 are made of a plastics material, and the various corners at the changes in section are rounded, as shown in FIG. 2.

If required, for instance for use when the reel axis is to be horizontal, a tie bar 29 may be threaded into the internally threaded peg 13 and into a threaded bore in the element 18. In this way, both the reel 14 and the element 18 may securely be fastened to the end wall 12.

In use, a reel 14 is positioned within the holder 10, the element 18 pressed on to end cheek 17, wire 9 from the reel passed through aperture 27, and element 21 then engaged with the outer surface of the wall 11, lug 26 engaging in groove 25. The wire 9 thus passes through a non-linear passage between the two elements 18 and 21, the degree of non-linearity being adjustable by rotation of the element 21 relative to the holder 10. The passage is circular in width, and a wire in passing from the reel 14 to the aperture 27 follows a zig-zag path, so that on drawing the wire through the aperture, the wire is subjected to drag caused by internal friction in following the zig-zag path and by friction against the corners at the changes in diameter of the elements 18 and 21.

As the wire is drawn out of the aperture, the wire is unwound from the reel 14 and runs over the end cheek 17 to enter the passage at the instantaneous point of leaving the reel. Wear is thus spread over the entire periphery of the co-operating surfaces of the elements defining the passage, and these parts may thus be expected to have a relatively long life. To ensure repeatability in setting of the passage dimensions, the skirt 24 of the element 21 and/or the wall of the holder engaged therewith may be calibrated with appropriate designations.

Figure 3:
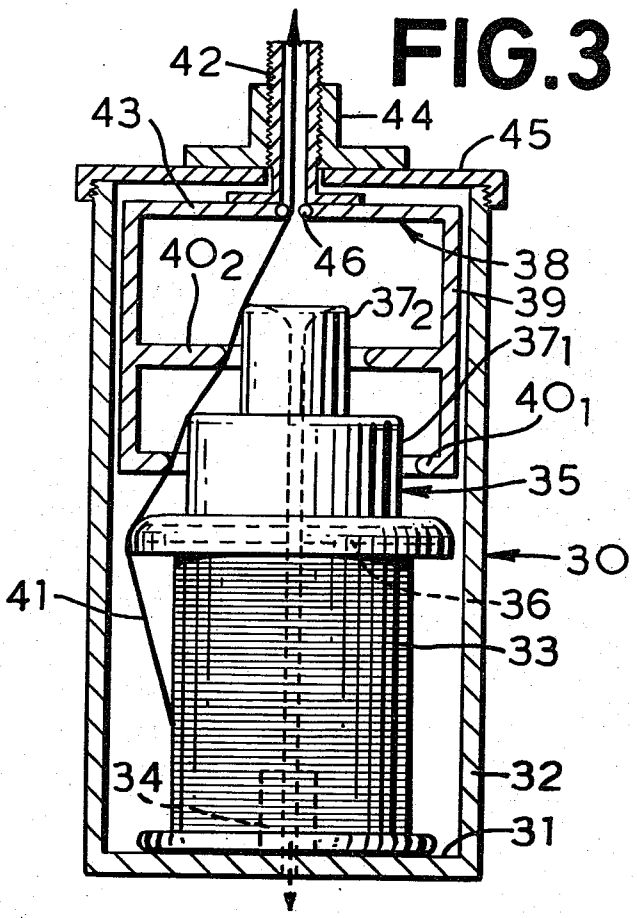
FIG. 3 is a cross-sectional view through a second embodiment of reel holder and wire-tensioning device.

FIG. 3 shows a second embodiment of this invention which, while functionally equivalent to that described above, is configured somewhat differently. This device comprises a reel holder 30 having a base plate 31 and an upstanding cylindrical wall 32. A reel 33 is held centrally in the holder 30 by means of a peg 34 upstanding from the base plate, and has a first element 35 pressed on to the upper end cheek 36 thereof. The first element is of circular cross-section and has two portions $37_1$, $37_2$ of different diameter.

A second element 38 has a cylindrical member 39 which is slidably disposed within wall 32 and a pair of internal flanges $40_1$, $40_2$ designed respectively to co-operate with portions $37_1$, $37_2$ of element 35, thereby to define a zig-zag passage for wire 41 drawn from the reel 33. The second element 38 is supported by a hollow stud 42 affixed to a top plate 43 of the second element, which stud is threadingly engaged with a boss 44 mounted on a removable cover 45 to the reel holder. Relative rotation of the second element to the cover 45 thus raises or lowers the second element and hence changes the degree of non-linearity of the passage for wire drawn from the reel.

The wire leaves the device through the hollow stud 42, the inner end of stud being bounded by relatively hard bead 46 to reduce wear in this region.

The just described embodiment functions in essentially the same manner as that previously described; as before the passage defining the zig-zag path is circular and wire may enter the passage at any point on the periphery thereof, as the wire leaves the reel. In this way, localised wear is eliminated.

Instead of the wire 41 leaving the device described above through the hollow stud 42, both the first element 35 and the peg 34 may be formed with central passage ways 37 and 48 respectively, so that the wire may follow the path shown in broken lines, to leave the device through the base plate 31. Similarly the device of FIGS. 1 and 2 may be designed to allow the wire to leave through the base plate thereof.

Figure 4:
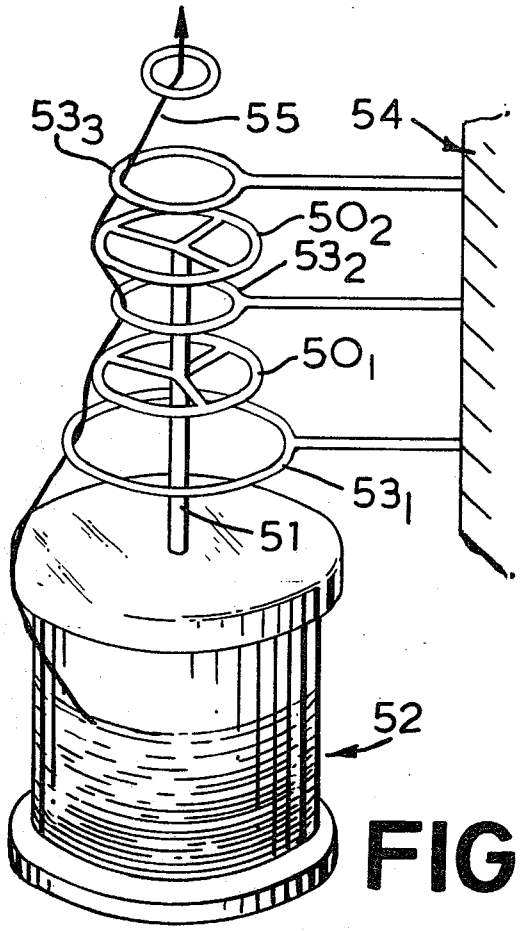
FIG. 4 is a diagrammatic view of a third embodiment of this invention.

FIG. 4 diagrammatically shows yet another arrangement which is functionally equivalent to that described with reference to FIGS. 1 and 2. Here, one element is defined by two rings $50_1$, $50_2$ mounted on a suitable support 51 affixed to a held reel 52 and co-operating with three further rings $53_1$, $53_2$, $53_3$ also mounted on a fixed support 54. Rings 50 are internally supported because the wire 55 passes over their external surfaces, whereas rings 53 are externally supported because the wire passes through those rings. The rings could be made of stiff wire, glass, ceramics or other hard materials.

Another equivalent structure may use, for the element mounted on the reel, a plurality of concentric tubes which upstand coaxially from the end cheek of the reel, the smallest diameter tube being the longest. Such tubes may be made of metal, suitably formed for instance by spinning, as may be the two elements of the embodiment of FIGS. 1 and 2.

Figure 5:
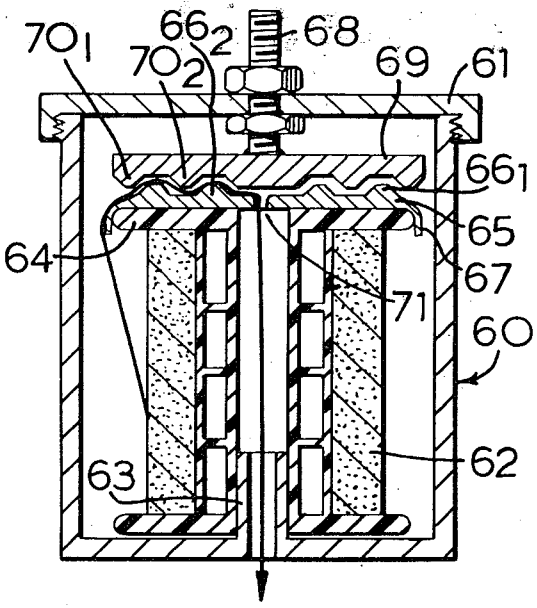
FIG. 5 is a cross-sectional view of a fourth embodiment of this invention.

Turning now to FIG. 5, the embodiment there shown comprises a reel holder 60 in the form of a cylindrical casing with a cover 61 threaded thereon, a reel 62 being located on a hollow peg 63 projecting from the base of the casing. Fitted on to one end cheek 64 of the reel is a first element 65 in the form of a disc with annular ridges $66_1$, $66_2$ upstanding from the face of the disc opposed to the reel. The disc has a skirt 67 which defines a recess into which the end cheek of the reel fits.

Mounted on a stud 68 fastened centrally to the cover 61 is a second element 69, also in the form of a disc and with annular ridges $70_1$, $70_2$ formed on its faces opposed to the first element 65, the ridges $70_1$, $70_2$ interfitting between the ridges $66_1$, $66_2$ so that a labyrinth-like passage for wire leaving the reel is defined thereby.

In this embodiment, the first element 65 is formed with a central aperture 71 which registers with the bore through the centre of the reel. The wire is thus taken through the labyrinth passage, through the aperture 71 and out of the device through the hollow peg 63.

The above described device operates generally in the same manner as the previously-described devices. If required, the stud 68 can permanently be fixed to the cover 61, so that when the cover is fastened to the casing, the two elements 65 and 69 take up a pre-set relative disposition. If the required tension is to be changed, then the cover can be removed together with the second element 69 and replaced by another which defines a wire passage of different dimensions. Another possibility is for the stud to be hollow and for the wire to leave the device through the hollow stud, instead of through the reel centre and the hollow peg 63.

Figure 6:
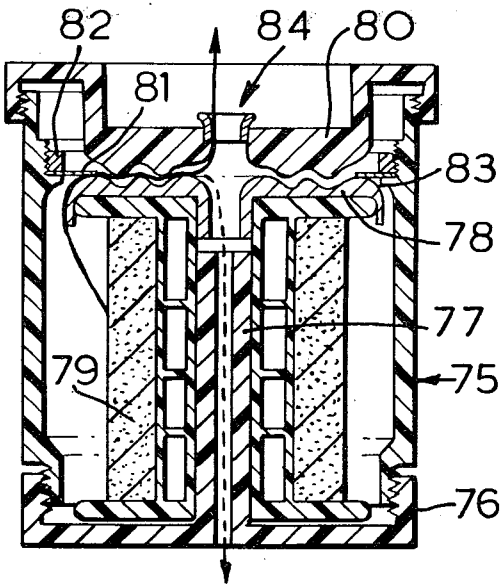
FIG. 6 is a cross-sectional view through a fifth embodiment including pre-tensioning arrangement.

FIG. 6 shows a device which generally is similar in operation to that described with reference to FIG. 5, but includes a pre-tensioning arrangement. This device comprises a reel holder 75 having a base cap 76 threaded thereto, which latter supports a hollow tie rod 77 engaged with a first element 78. A reel 79 can thus be clamped between the base cap 76 and first element 78. A second element 80 co-operates with the first element 78 to define a labyrinth passage for wire drawn from the reel, and is adjustably threadingly engaged with the holder 75. An annular disc 81 of relatively hard material is clamped internally within the holder by means of a threaded ring 82, so as to bear lightly upon a rounded shoulder 83 of the first element 78. The disc may have a polished smooth surface or a fibrous surface as appropriate to applying a pre-tension to wire drawn from the reel and entering the labyrinth passage between the two elements. The material of the disc and pre-tension applied depending for instance on the wire gauge, material, insulation, coating and so on. The wire may leave the device either through the hollow tie rod 77 and base cap 76, or through an aperture 84 provided centrally in the second element 80.

Figure 7:
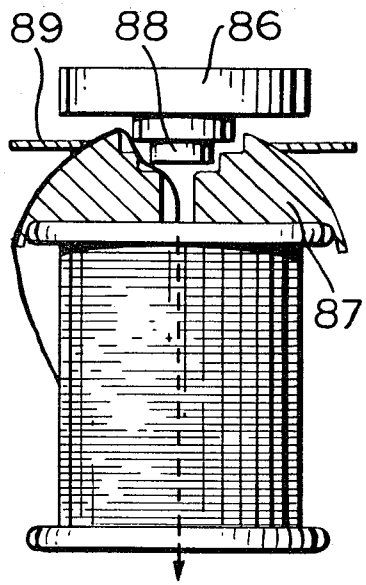
FIG. 7 is a sketch of an arrangement similar to that of FIGS. 1 and 2, but with a pre-tensioning arrangement and inverted elements.

FIG. 7 diagrammatically shows an arrangement of two co-operating elements 86, 87 somewhat similar to those of FIG. 1, but with the elements 'inverted' so that the smallest diameter portion 88 of the element 86 further from the reel is nearest the reel, and the element 87 nearer the reel fits around the other element 86. Moreover, a pre-tensioning arrangement comprising flexible annular disc 89 is disposed to bear on the periphery of element 87, with the wire passing between the disc and the element. The operation of this device is essentially the same as that of FIGS. 1 and 2, but with the addition of the pre-tensioning arrangement, to ensure that tension properly is applied in the non-linear passage.

I claim:

1. A device for imparting a tension to wire drawn from a reel, which device comprises holding means for holding a reel of wire, first and second circular tensioning elements, and support means for supporting said elements in a relatively spaced disposition to lie adjacent one end of a reel held by said holding means, each of said tensioning elements having at least one annular surface which said annular surfaces on said two elements co-operate with each other thereby to define a non-linear passage of circular form between said elements and along which wire may pass generally radially inwardly, said support means supporting both of said elements with said annular surfaces substantially co-axial with and adjacent one end of a reel held by the holding means and at least one of said elements having a central aperture through which wire drawn from the reel and passing radially inwardly through said passage may leave the device, whereby the wire wound on a held reel may be drawn from the reel to pass generally radially inwardly along said passage there to be constrained by said annular surfaces of said tensioning elements to follow a non-linear path and out of said aperture, said non-linear path imparting tension to the wire and the wire being able to enter said passage at any point around the circular periphery thereof as the wire comes off a held reel.

2. A device as claimed in claim 1, wherein said two tensioning elements are in the form of a pair of complementary stepped cylinders which interfit with clearance, the wire passage extending therebetween.

3. A device as claimed in claim 2, wherein one element defines at least two external concentric cylindrical portions of different diameters, one of said portions having a larger diameter and being adapted for positioning nearer a held reel, and the other element defines at least two corresponding internal cylindrical portions, said other element fitting over said one element.

4. A device as claimed in claim 1, wherein said tensioning elements each is defined by a plurality of rings of different diameters and spatially fixed with respect to one another, said rings of one element alternating with those of the other.

5. A device as claimed in claim 1, wherein one of said tensioning elements defines a stepped cylinder and the other said element has a plurality of flanges projecting radially inwardly from an internal cylindrical surface, the flanges defining circular apertures for co-operation with the step cylinder thereby to define said non-linear passage.

6. A device as claimed in claim 1, wherein each tensioning element is in the form of a substantially flat disc, the support means serving to support said two discs co-axially and parallel to one another, said discs having on their opposed faces annular upstanding protrusions, said protrusions on one disc interfitting between said protrusions on the other.

7. A device as claimed 1, wherein said annular surfaces have corner portions to constrain wire drawn from a held reel to follow a non-linear path, said corner portions being convexly profiled to prevent relatively high point loads occurring on the wire.

8. A device as claimed in claim 1, wherein said support means includes adjusting means which allows the spacing of said tensioning elements to be adjusted.

9. A device as claimed in claim 1, wherein the holding means has an end plate and a reel of wire is held by and between said end plate and one of said tensioning elements.

10. A device as claimed in claim 9, wherein the held reel is defined by a central core on which wire is wound and two end cheeks, one of said end cheeks being adjacent said one tensioning element and said one tensioning element having an overall diameter substantially the same as the end cheek of the held reel adjacent said one tensioning element.

11. A device as claimed in claim 1, wherein said central aperture is provided in said tensioning element nearer a held reel, so that on leaving the passage wire passes out of the device through said central aperture and thence through a central bore provided through a held reel.

12. A device as claimed in claim 1, wherein means are provided to apply a pre-tension to the filament, prior to the filament passing through the passage defined between said two tensioning elements.

13. A device as claimed in claim 12, wherein said pretensioning means comprises a resilient member bearing on one of the tensioning elements adjacent the periphery thereof, the filament passing between said resilient member and said one element before entering the passage between said two elements.

* * * * *